United States Patent [19]

Adamoli et al.

[11] Patent Number: 4,718,553

[45] Date of Patent: Jan. 12, 1988

[54] TAMPER-EVIDENT PACKAGING, METHOD OF MAKING SAME, AND INTERMEDIATE THEREIN

[75] Inventors: Anthony R. Adamoli, Lafayette; Robert P. Jewett, Old Tappan; Herbert Friedman, Fort Lee; Alan A. Chalem, Clifton, all of N.J.

[73] Assignee: Ivy Hill Corporation, New York, N.Y.

[21] Appl. No.: 13,390

[22] Filed: Feb. 11, 1987

[51] Int. Cl.[4] ..... B65D 65/40

[52] U.S. Cl. ..... 206/459; 206/807; 215/365; 116/201; 383/5; 229/102

[58] Field of Search ..... 206/807, 459; 215/365; 116/201; 383/5; 229/102

[56] References Cited

U.S. PATENT DOCUMENTS

| | | | |
|---|---|---|---|
| 1,003,443 | 9/1911 | Erickson . | |
| 3,925,584 | 12/1975 | Suzuki et al. . | |
| 4,082,873 | 4/1978 | Williams . | |
| 4,097,236 | 6/1978 | Daly et al. . | |
| 4,197,947 | 4/1980 | Zaidi . | |
| 4,246,307 | 1/1981 | Tarutwein . | |
| 4,424,911 | 1/1984 | Resnick . | |
| 4,432,462 | 2/1984 | Newkirk . | |
| 4,436,213 | 3/1984 | Paul, Jr. et al. . | |
| 4,457,430 | 7/1984 | Darling et al. . | |
| 4,475,661 | 10/1984 | Griffin . | |
| 4,479,588 | 10/1984 | Davis et al. . | |
| 4,480,749 | 11/1984 | Laucis et al. . | |
| 4,489,841 | 12/1984 | Thompson | 215/365 X |
| 4,509,196 | 4/1985 | Sak et al. . | |
| 4,516,679 | 5/1985 | Simpson et al. | 206/459 |
| 4,566,627 | 1/1986 | Grendon . | |
| 4,603,785 | 8/1986 | Gach . | |

OTHER PUBLICATIONS

Preprint of article by Carl Croce, pp. 1-9, especially bottom of p. 2, later printed in Theory and Practice of Industrial Pharmacy, Oct.-Nov., 1986.

Packaging Digest, Dec. 1986, pp. 36, 42.

Packaging, Oct. 1986, pp. 63, 65-68, especially p. 68.

Packaging, Jan. 1987, p. 107, "Tamper-proof Identification Tag".

*Primary Examiner*—William Price

*Attorney, Agent, or Firm*—Amster, Rothstein & Ebenstein

[57] ABSTRACT

Tamper-evident packaging comprises an erected, filled, and closed carton having an outer surface with ink printed thereon visible from outside of the closed carton, and transparent film overwrapping the closed carton and secured to the ink on the outer carton surface in selected differentially adherent patterns. Removal of the film from the overwrapped carbon also removes the ink in one of the patterns to reveal the desired pattern of deinked outer carton surface and to thereby evidence tampering with the packaging.

20 Claims, 13 Drawing Figures

FIG. 1
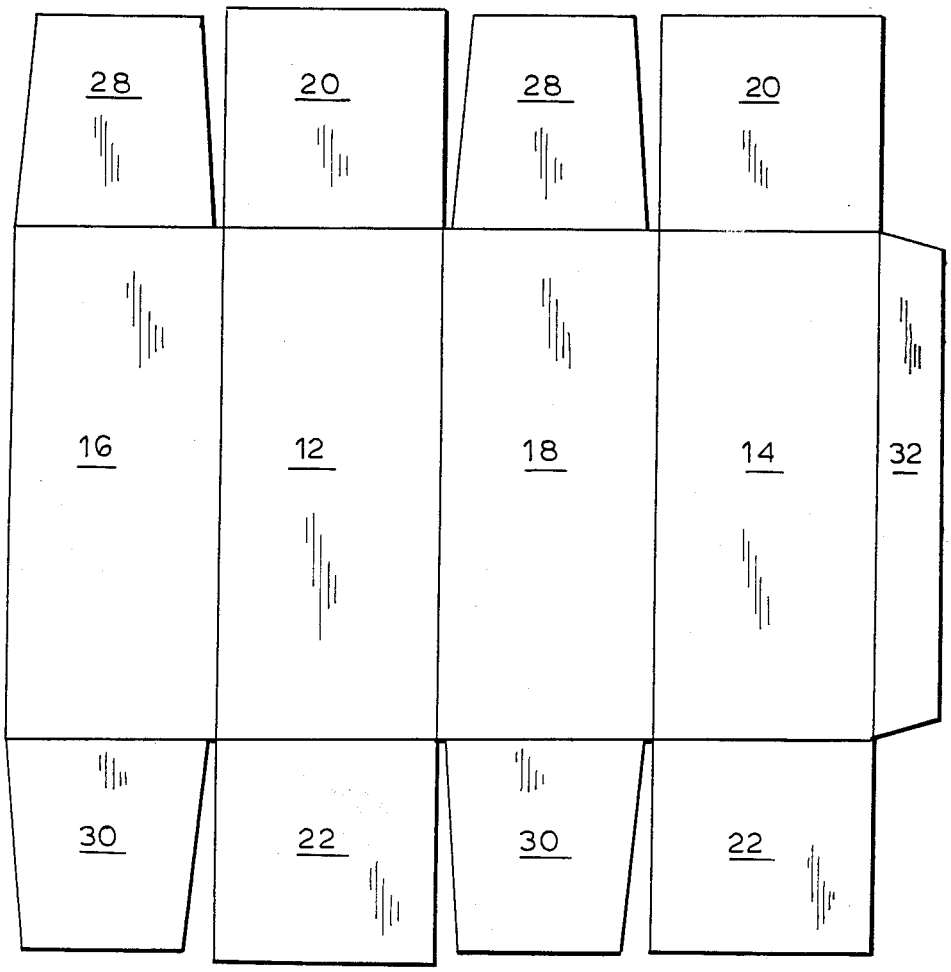
FIG. 2
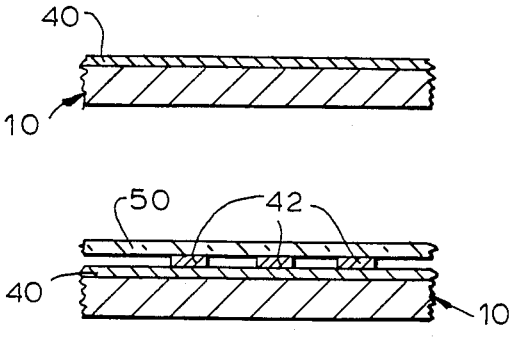
FIG. 3
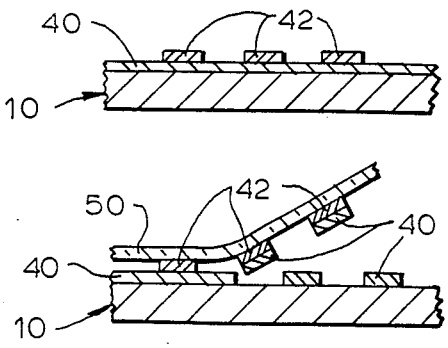
FIG. 4
FIG. 5

FIG. 8
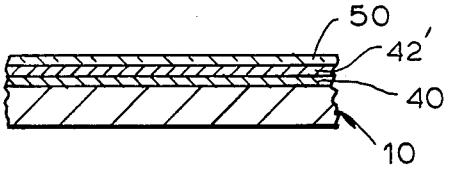
FIG. 11
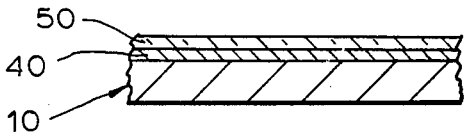
FIG. 9
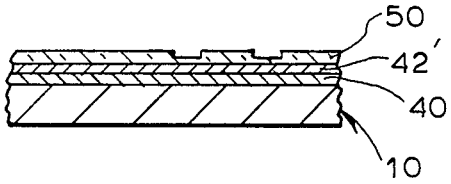
FIG. 12
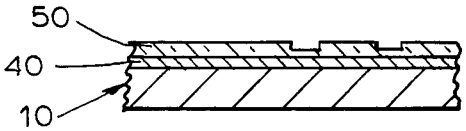
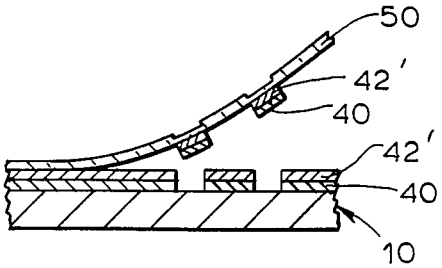
FIG. 10
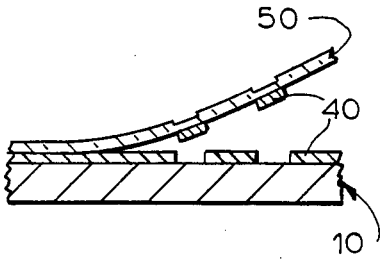
FIG. 13

TAMPER-EVIDENT PACKAGING, METHOD OF MAKING SAME, AND INTERMEDIATE THEREIN

BACKGROUND OF THE INVENTION

The present invention relates to packaging and, more particularly to tamper-evident packaging of the type which clearly evidences to a potential purchaser of the product whether or not the integrity of the packaging has been breached.

In recent years, illegal tampering with just a few packages of consumer products, especially consumer products intended for ingestion, have caused death, illness, widespread public fear and the costly recall of millions of packages from retailer's shelves. As a result, there have been numerous and diverse attempts to provide packaging which would show positive visual evidence of any attempt to compromise the integrity or otherwise tamper with the containers in which such products as over the counter drugs, pharmaceuticals, foods or the like are typically packaged. However, none of the commonly used tamper-evident packaging techniques involving folding carton packages have proven to be entirely satisfactory in use. The gluing or sealing of carton ends together has not hampered a skilled and determined tamperer from, for example, using a sharp blade to cut through the carton sealing adhesive, adulterating the contents of the inner package, and then regluing the carton ends without leaving any telltale indication that the integrity of the packaging has been compromised. The use of heat-sealed or shrink-type carton overwrap has not deterred tamperers as the overwrap material is generally available so that the tamperer can easily remove the overwrap from the carton, adulterate the contents of the carton, and apply look-alike overwrap to the carton without leaving any indication that the carton integrity has been compromised. A reliable tamper-evident packaging system must ensure that the tampering causes a permanent change to an essential element of the packaging which is visually evident.

Various patents have been directed to tamper-evident packaging, switch-proof labels and the like.

U.S. Pat. No. 4,097,236 discloses a tamper-evident system which relies on the principle that a ruptured heat-seal exhibits a different color than an unruptured heat seal.

U.S. Pat. No. 4,246,307 discloses a laminated sticker card, the laminate including a printed inner layer which adheres to a substrate and an outer layer. Portions of the printed inner layer adjacent the substrate are preferentially adhered at certain locations to the substrate and at other locations to the outer layer of the laminate, so that an attempt to remove the laminate from the substrate results in tearing of the printed inner layer at the preferentially adhered locations.

U.S. Pat. Nos. 1,003,443 and 4,082,873 disclose switch-proof labels which are intended to prevent labels from being removed from one container and applied to another by causing the tampering to destroy the visual integrity of the labels.

However each of these patented systems requires that the user be alert to the special circumstances which indicate tampering. In other words, the systems fail to provide an unequivocal message which even the first time user of the product will recognize as an intended communication, let alone a warning of tampering.

Accordingly, it is an object of the present invention to provide tamper-evident packaging wherein the tampering is evidenced by the appearance of a desired graphic or verbal communication on the outer surface of the container.

Another object is to provide tamper-evident packaging in which removal of a carton overwrap causes clear and unequivocal notice of tampering to appear on the carton surface, so that such notice will remain on the carton surface even if new overwrap is applied thereto or other steps are taken to attempt to hide the evidence of tampering.

A further object is to provide such tamper-evident packaging at only a minimal cost over regular packaging.

It is also an object to provide a method of manufacturing such tamper-evident packaging and an intermediate useful in such manufacture.

SUMMARY OF THE INVENTION

It has now been found that the above and related objects of the present invention are obtained in tamper-evident packaging comprising an erected, filled, and closed carton having an outer surface with ink thereon visible from outside of the closed carton. A transparent film overwraps the closed carton and is secured to the ink on the outer carton surface in selected differentially adherent paterns. Removal of the film from the overwrapped carton also removes the ink in one of the patterns to reveal the desired pattern of deinked outer carton surface and thereby evidence tampering.

In a first preferred embodiment of the present invention, the packaging additionally comprises a transparent heat-sealable coating disposed in the one selected pattern intermediate the ink and the film, the coating being bonded to an underlying portion of the ink and to the film. Thus, removal of the film from the overwrapped carton also removes the coating and the underlying portion of the ink in the one selected pattern to reveal an outer carton surface deinked in the configuration of a meaningful message to evidence tampering. In a second preferred embodiment, the packaging additionally comprises a transparent heat-sealable coating uniformly disposed intermediate the ink and the film. The coating is uniformly bonded to the underlying ink and has been activated by a selected application of heat and pressure to bond in the one selected pattern with the film. Thus, removal of the film from the overwrapped carton also removes coating in the one selected pattern and an underlying portion of the ink in the one selected pattern to reveal an outer carton surface deinked in the form of a meaningful message to evidence tampering. In a third preferred embodiment, the film is directly and immediately secured to the ink on the outer carton surface in selected differentially adherent patterns as a result of the selective application of heat and pressure to the film. When the film is removed from the carton, the film causes removal of the ink from the outer carton surface in a selected pattern to evidence tampering. Thus, the tamper-evident packaging of the present invention encompasses three preferred embodiments: a first wherein there is a given pattern of heat-sealable coating on the ink, a second wherein the heat-sealable coating is uniformly disposed over the ink but heat and pressure are applied to the film in the given pattern, and a third wherein there is no heat-sealable coating but the film is directly and immediately secured to the ink in the given pattern as a result of the differential application of heat and pressure to the film.

In the preferred first embodiment, the ink is secured to the outer carton surface in a pattern of surface detail by a first bond, the transparent heat-sealable coating is secured to the ink in a given pattern by a second bond, and the overwrap film is secured to the patterned coating by a third bond. The second and third bonds are appreciably stronger than the first bond so removal of the film from the overwrapped carton also removes the coating and the portion of the ink underlying the coating to reveal a desired pattern of deinked outer carton surface and thereby evidence tampering. The bonding of the overwrap film to the heat-sealable coating may be achieved by the application of heat and pressure to the outer surface of the overwrap film, and preferably by the uniform application of heat and pressure over the entire outer surface of the overwrap film, or at least that portion of the outer film surface overlying the heat-sealable coating.

An intermediate in the manufacturing of the first embodiment of the tamper-evident packaging comprises a carton blank adapted to be erected into a carton, filled with product, closed, and overwrapped with a transparent film. Ink defining a pattern of surface detail is secured by a first bond to the surface of the blank becoming the outer surface of the erected carton. A transparent heat-sealable coating is disposed on the ink in a given pattern, the coating forming a second bond between the ink and coating and being activatable to form a third bond between the coating and the film. The second and third bonds are appreciably stronger than the first bond, whereby removal of the film from the overwrapped carton also removes the coating and the portion of the ink underlying the coating to reveal a pattern of deinked outer carton surface and to thereby evidence tampering.

Preferably the second and third bonds are of generally equal strength and the ink is either substantially not heat sealable with the film in the absence of the coating therebetween or the direct and immediate bonding of the ink to the film is weaker than the first bond. The coating is preferably disposed on the ink in the given pattern such that removal of the ink in the given pattern reveals indicia evidencing tampering. The given pattern comprises indicia evidencing tampering and may comprise graphic or verbal communications (such as a skull and crossbones or the words "VOID", "TAMPERED", "UNSEALED" or "UNSAFE"). Preferably the carton is comprised of paperboard, the ink is lithographic ink, the coating is an acrylic and the film is biaxially-oriented polypropylene. The coating is typically activated by the application of heat and pressure to form the third bond, for example, at 200°-300° F. and 10-20 psi for 1-2 seconds.

The tamper-evident packaging of the present invention is made by providing an erected, filled and closed carton having an outer surface with ink thereon visible from outside the closed carton. The closed carton is overwrapped with a transparent film, and the film is secured to the ink on the outer carton surface in selected differentially adherent patterns. Removal of the film from the overwrapped carton also removes the ink in one of the selected patterns to reveal the desired pattern of deinked outer carton surface to evidence tampering.

To make the first embodiment, prior to the overwrapping step a transparent heat-sealable coating is disposed in the one selected pattern on the outer carton surface and uniformly bonded to the underlying portions of the ink. During the overwrapping step the film is secured to the ink by activating the coating with a uniform application of heat and pressure to bond the coating to the film in the one selected pattern. Thus, removal of the film from the overwrapped carton also removes the coating and the underlying portion of the ink, both in the one selected pattern, to reveal an outer carton surface deinked in the form of a meaningful message to evidence tampering. To make the second embodiment, prior to the overwrapping step a transparent heat-sealable coating is uniformly disposed on the outer carton surface and uniformly bonded to the underlying ink, and during the overwrapping step the coating is activated by the selective application of heat and pressure to bond the coating in the one selected pattern with the film. Thus, removal of the film from the overwrapped carton also removes the one selected pattern of coating and the underlying portion of the ink in the one selected pattern to reveal an outer carton surface deinked in the form of a meaningful message to evidence tampering. The ink is secured to the outer carton surface by a first bond, the heat-sealable coating is secured to the ink by a second bond, and the film is secured to the coating by a third bond, the second and third bonds being stronger than the first bond. To make the third embodiment, during the overwrapping step the film is directly and immediately secured to the ink on the outer carton surface in selected differentially adherent patterns as a result of the differential application of heat and pressure to the film.

A method of manufacturing the intermediate of the first embodiment comprises the steps of providing a carton blank adapted to be erected into a carton, filled with product, closed, and overwrapped with a transparent film. Ink is applied in a pattern of surface detail to a surface of the blank becoming the outer surface of the erected carton, the ink being secured to the outer surface by a first bond. A transparent heat-sealable coating is applied on the ink in a given pattern, the coating forming a second bond with the ink and being activatable to form a third bond with the film, the second and third bonds being appreciably stronger than the first bond. Removal of the film from the overwrapped carton also removes the coating and the portion of the ink underlying the coating to reveal a desired pattern of deinked outer carton surface to evidence tampering.

BRIEF DESCRIPTION OF THE DRAWING

The above brief description, as well as further objects and features of the present invention, will be more fully understood by reference to the following detailed description of the presently preferred, albeit illustrative, embodiments of the present invention when taken in conjunction with the accompanying drawing wherein:

FIG. 1 is a top plan view of an open carton blank;

FIG. 2 is a fragmentary sectional view of the carton blank of FIG. 1 having a layer of ink thereon;

FIG. 3 is a fragmentary sectional view of the composite of FIG. 2 having a pattern of heat-sealable coating thereon;

FIG. 4 is a fragmentary sectional view of the composite of FIG. 3 having a transparent overwrap thereon;

FIG. 5 is a fragmentary sectional view of the composite of FIG. 4 showing the overwrap being removed and taking therewith the heat-sealable coating and underlying portions of the ink;

FIG. 8 is a fragmentary sectional view of an intermediate in the manufacture of a second embodiment of the present invention prior to the selective application of heat and pressure;

FIG. 9 is a fragmentary sectional view of the composite of FIG. 8 after the selective application of heat and pressure;

FIG. 10 is a fragmentary sectional view of the composite of FIG. 9 showing the overwrap being removed and taking therewith portions of the heat-sealable coating and underlying portions of the ink;

FIG. 11 is a fragmentary sectional view of an intermediate in the manufacture of the third embodiment of the present invention prior to the selective application of heat and pressure;

FIG. 12 is a fragmentary sectional view of the composite of FIG. 11 after the selective application of heat and pressure; and FIG. 13 is a fragmentary sectional view of the composite of FIG. 12 showing the overwrap being removed and taking therewith portions of the ink.

DETAILED DESCRIPTION OF THE PREFERRED EMBODIMENTS

Figure 6:
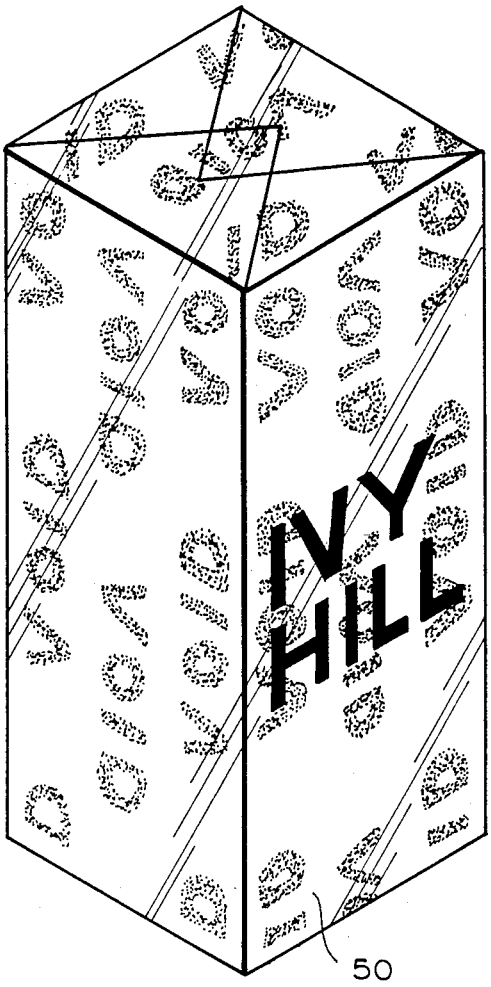
FIG. 6 is an isometric view of an untampered package according to the present invention with the word "VOID" being shown thereon with more prominence than would actually be the case.

Referring now to the drawing, and in particular to FIG. 1 thereof, therein illustrated is a carton blank generally designated by the reference numeral 10. The carton blank 10 is configured and dimensioned for eventual use as the familiar paperboard carton used for small medicaments, such as aspirin, and the like although the principles of the present invention are equally applicable to paperboard cartons of widely disparate sizes, shapes and styles. For example, the paperboard cartons may be of the seal-end or tuck-end styles, the former generally being considered as affording the most advantageous tamper-evident packaging characteristics but the latter, despite its deficiencies in this area, being made relatively more acceptable by the application of the principles of the present invention thereto. The illustrated carton 10 is a seal-end carton and includes a front panel 12, a rear panel 14 and two side panels 16, 18.

Disposed above the front and back panels 12, 14 are top flaps 20, and disposed below the panels are bottom flaps 22, each of the flaps 20, 22 being configured and dimensioned to close an open top or open bottom respectively, of the erected carton. The side panels 16, 18 have at their tops upper tabs 28 and at their bottoms lower tabs 30. The upper tabs 28 are adapted to fold inwardly underneath the top flaps 20, while the lower tabs 30 are adapted to fold inwardly and underneath the bottom flaps 22. The tabs 28, 30 are held in position by the flaps 20, 22, respectively, by glues or the like. The manufacturer's glue tab 32 extends along the free side of back panel 14 and is adapted to be glued or otherwise secured to the free side of the side panel 16 during finishing of the carton by box manufacturers so as to maintain the various panels 12, 14, 16, 18 in a three-dimensional construction of rectangular cross-section.

The carton blank 10 may be formed of any paperboard adapted to be printed with ink. A preferred paperboard is the blister pack paperboard commercially available under the trade name BLIS-PAC from Federal Paperboard Co., Inc. of Riegelwood, N.C. 28456. The surface of the paperboard provides relatively easy release of any plastic overwrap film that has been adhered to it. The paperboard is a solid bleached sulphate (SBS) paperboard specifically designed for the blister packaging industry and meets the primary dual requirements of good printability and excellent heat sealing characteristics. It is double clay coated, low density paperboard and available in calibers of 0.016–0.028 inch thickness. The paperboard is preferably 0.016–0.018 inch thick and of appropriate size to be processed by the available printing equipment.

Referring now to FIG. 2 in particular, the surface of the blank destined to become the outer surface of the erected carton is printed with ink 40 to provide the ornamental appearance of the carton. Any low wax content ink may be employed for this purpose. The ink is preferably wax-free so as to allow good adhesion of the ink to heat-sealable coatings which may be applied thereto, with offset sheet-fed lithographic ink of the type commonly used in blister pack printing being preferred. The equipment used to apply the ink may depend upon the available equipment of the given carton manufacturer. Preferably an offset lithographic printing press with five printing stations and a press speed of approximately 4,500 impressions per hour is employed. A paperboard sheet, from which a plurality of carton blanks 10 will be die cut, is fed into the machine with various areas of the sheet receiving different colored inks at different stations of the press from conventional offset lithographic (planographic) printing plates. For example, with respect to the packaging shown in FIG. 6, the product name "IVY HILL" may be printed in black ink at one station, and the remainder of the carton printed in blue ink at a subsequent station.

Referring now in particular to FIG. 3, therein illustrated is the carton blank 10 having a pattern 42 of heat-sealable coating segments disposed on the exposed surface of the ink 40. The coating 42 is a commercially available transparent water-based acrylic heat-sealable coating such as that sold under the trade name 9489-011 by the Valspar Corporation of Pittsburgh, Pa. The coating is white when wet, but colorless when dry; and the dried coating is sufficiently clear to allow the printed ink colors 40 therebelow to show through. Application of the heat-sealable coating to the ink may be facilitated and improved by the addition of suitable viscosity modifiers to the coating according to techniques well recognized by the coating art. The coating is conveniently applied to the ink surface 40 of the carton blank 10 at the last printing station of the five printing station press, the last station having been converted to a coating station. While the coating 42 may be applied on dry ink, it may also be applied to wet ink. In either instance use of a raised or relief printing plate is the preferred application method. The coated sheets are passed through an infrared drying unit in order to hasten drying of the aqueous-base coating 42 as well as any wet ink 40. In order to allow for the slow drying of any solvent-based ink, the sheets are allowed to dry in short stacks (approximately 300–500 sheets per stack) for four days. The drying time may range from a half day to several days depending upon the available temperature, moisture level, variables of raw materials, the number of sheets per stack, etc. The sheets are then die cut into folding carton forms having the outline of blank 10 of FIG. 1.

It will be appreciated that different low wax or no wax inks may be used and that such inks may be applied by a variety of different printing techniques well known to those in the carton printing field. Similarly, it will be appreciated that a variety of heat-sealable coatings may be utilized and these coatings may be applied and dried by a variety of different processes well known to those familiar with the coating art. It is important, however, that the bond between the ink 40 and the coating 42 immediately thereabove be appreciably stronger than the bond between the ink 40 and the carton 10 immediately therebelow.

The pattern 42 in which the heat-sealable coating is applied is designed to provide evidence of tampering with the carton should the pattern become visible. The communication of the pattern 42 may be graphic (for example, a picture of a skull and crossbones) or verbal (for example, the words "VOID"—as illustrated—"-TAMPERED" or "UNSAFE"). It is a primary feature of the present invention that the pattern 42 may be selected so as to communicate the fact of tampering even to first time purchasers of the product who are unfamiliar with the system and unable to distinguish between subtle differences in coloring, the absence of an overwrap, or a torn label resulting from tampering as opposed to merely rough handling during manufacture, storage or sale. Thus, communications such as "TAMPERED" or "DO NOT BUY" are preferred.

The intermediate composite represented in FIG. 3—comprising the carton blank 10, the ink 40 and the coating 42—represents an intermediate useful in the manufacture of the final tamper-evident packaging of the present invention, the intermediate typically being manufactured by a carton manufacturer for sale to a packager, who then erects the cartons from the carton blanks, fills the cartons with his product, closes the ends and then overwraps the closed carton with a transparent film.

Thus, after receiving the composite of FIG. 3, the packager, when it is time to erect the carton, folds it into the rectangular shape, folds up lower tabs 30 and closes bottom flaps 22 thereover. The product (such as a bottle of aspirin) is then inserted through the open top of the erected carton after which the top tabs 28 are folded down and secured in place by the top flaps 20. Securing means, such as hot melt or other glue, is used to ensure integrity of the closures.

Referring now to FIG. 4 in particular, the erected, filled and closed carton is then overwrapped with a transparent film 50. While any of the conventional transparent overwrap films which have the ability to heat seal well with the coating 42 may be employed as the overwrap film 50, preferred films are the two-sided acrylic heat-seal coated, biaxially oriented polypropylene commercially available under the trade name BICOR 220AB, 310AB and 380AB or the one-side PVDC, one-side acrylic coated biaxially oriented polypropylene film available under the trade name BICOR AB (both available from the Films Division of the Mobile Chemical Company). Both films are intended for general overwrap application on wrapping machines designed for use with polypropylene. The former affords excellent strength, moisture barrier and appearance; the latter has outstanding optical properties, exceptional dimensional stability and combines excellent machinability on the acrylic coated outer surface and excellent sealability and gas barrier properties on the polyvinylidene chloride coated inner surface.

The transparent film 50 requires only a level of transparency consonant with the purposes of the present invention—that is, a transparency extending over such a fraction of the film area that at least a substantial number of the inked carton surface portions overlaid with coating 42 are visible therethrough. Within these constraints, the transparent film 50 may be tinted or have portions thereof opaquely printed with ornamental, advertising, or informational matter.

If desired, a conventional tear strip (not shown) of pressure sensitive propylene tape may be applied to the inside of the film, the inside being the side which will be adhered to the heat-sealable coating 42.

It will be appreciated that the acrylic and PVDC coatings of the transparent film 50 differ substantially from the heat-sealable coating 42. The coatings of the film 50 are primarily to enable the film to stick to itself so that a longitudinal seam may be formed and the ends folded over; thus these film coatings are intended primarily to seal to themselves. On the other hand, the heat-sealable coating 42 is intended to seal both with the ink 40 and the transparent film 50. It is a critical feature of the present invention that the bond of the heat-sealable coating 42 both with the ink 40 thereunder and the transparent film 50 thereabove be appreciably stronger than the bond between the ink 40 and the carton 10 or for that matter the rather weak bond, if any, which may form between the transparent film 50 and the ink 40 directly. Preferably the bonds between the heat-sealable coating 42 and the transparent film 50, on the one hand, and the heat-sealable coating 42 and the ink 40, on the other hand, are at least roughly equal, both being appreciably stronger than the bond between the ink 40 and the carton 10. The bonding of the overwrap film 50 to the heat-sealable coating 42 is accomplished by the application of heat and/or pressure to the overwrap film 50. while the temperatures and pressures required will vary with the particular overwrap film 50 and heat-sealable coating 42, generally pressures of about 10–20 p.s.i. and temperatures of 200°–300° F. (preferably about 270° F.) for approximately 1–2 seconds suffice. The temperature and pressure are uniformly applied over the entire surface of the overwrap film, or at least that portion of the film surface overlying the heat-sealable coating. If desired, the pressure need not be externally applied, but may be produced through the use of a heat-shrinkable overwrap film 50 which produces the requisite pressure by shrinking abut the overwrapped carton during the application of heat thereto. The heat may be applied by various conventional means such as conduction, convection, or radiation.

While polypropylene, and especially biaxially oriented polypropylene, is a preferred overwrap material, other materials well recognized in the overwrap art may also be used. Some of these materials may be used on the same overwrap equipment as polypropylene, while others, such as cellophane, may require different or modified overwrap equipment.

Referring now in particular to FIG. 6, therein illustrated is an overwrapped carton comprising a white surface of paperboard 10 printed all over with blue ink 40, except where balck ink in the form "IVY HILL" is disposed, a transparent, almost unnoticeable pattern 42 of heat-sealable coating disposed over the ink 40 (here exaggerated for illustrative purposes), and a transparent overwrap 50 overwrapping all.

Figure 7:
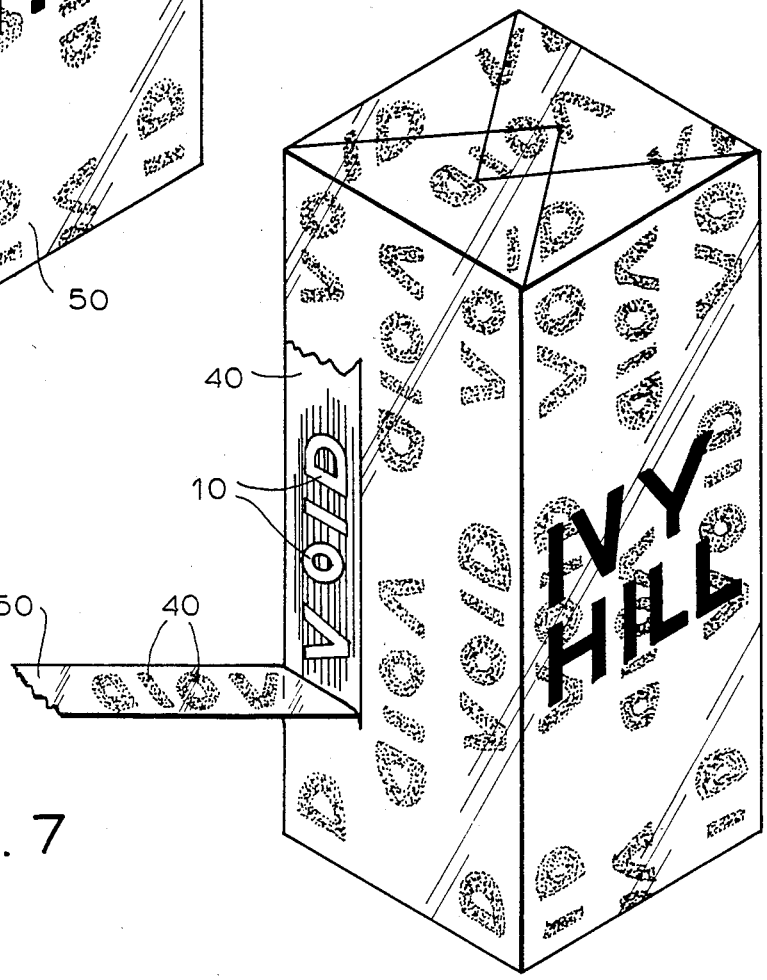
FIG. 7 is an isometric view similar to FIG. 6, but showing a portion of the carton in a tampered state.

Referring now to FIGS. 5 and 7 in particular, upon removal of a portion of the transparent film 50, as might occur during tampering, the transparent overwrap portion being removed carries with it the underlying pattern of heat-sealable coating 42 and the portion of the ink 40 thereunder to reveal the white outer surface of the carton 10. The white surface of the carton 10 stands out clearly against the blue background of the ink 40 so that the potential purchaser sees the word "VOID" in white against the blue background. As earlier noted, other words of caution or graphic representations may be used to communicate to the potential purchaser that the packaging has been tampered with.

As earlier noted, the carton 10 is generally formed of paperboard having a clay coating on the outer surface thereof. This clay is typically white, and it is the clay which is typically exposed as the ink 40 is torn away from the paperboard of the carton, along with the overwrap film 50 and heat-sealable coating 42. Where the ink 40 is strongly adherent to the clay surface of the carton 10, the clay coating may separate, an outer portion being removed from the carton along with the ink and an inner portion remaining on the paperboard fibers, visible to the user. In the instances where the paperboard lacks any clay coating and the ink 40 is strongly adherent to the outer surface of the paperboard of carton 10, some tearing of the paperboard fibers may also occur. While this in no way detracts from the tamper-evident nature of the packaging, it can present a more unsightly open product for the purchaser, makes it harder to remove the overwrap film, and, depending upon the degree of tearing, can result in a blurred image of the message being communicated to the purchaser. Accordingly, it is preferred that the ink 40 and paperboard 10 be selected to provide for a relatively clean removal of the ink from the paperboard.

It will be appreciated that in the first embodiment of the present invention described above, the overwrap film is secured to the ink in differentially adherent patterns through the use of an intermediate pattern of heat-sealable coating. Thus, the film 50 is tightly adherent to the ink 40 where the pattern of heat-sealable coating 42 is present and is not at all, or only slightly, adherent in the pattern created by the absence of the heat-sealable coating 42. Also within the scope of the present invention are other means of achieving differentially adherent patterns between the transparent film overwrapping the closed carton and the ink secured to the outer carton surface.

Referring now to FIGS. 8–10, therein illustrated is a second embodiment of the present invention wherein the differentially adherent patterns between the transparent overwrapped films 50 and the ink 40 are achieved by use of a uniform heat-sealable coating 42' and the selective application of heat and pressure to produce the desired pattern.

Referring now to FIG. 8 in particular, the composite of FIG. 2—comprising a carton 10 and ink 40—has applied thereto a uniform layer 42' of a heat-sealable coating. A transparent film 50 is overwrapped about the erected, filled and closed carton in the same manner as in the first embodiment.

Referring now to FIG. 9, heat and pressure are then selectively applied to the overwrap film 50 so as to activate the heat-sealable coating 42' therebelow only in particular areas comprising the desired pattern. Thus, the desired pattern of heat-sealable coating 42' bonds to the overwrap film 50 only in the given pattern. The pressure, temperature and time required to achieve the necessary activation of the heat-sealable coating portions will, of course, be a function of materials used. Generally, a relatively swift kiss with a heated embossing die suffices, the optimum parameters for the operation being easily determined by conventional experimentation with the aforesaid parameters. The selective application of heat and pressure to activate the coating 42' in the desired pattern may result in slight surface depressions in the desired pattern on the upper surface of the overwrap film 50, as shown to a greatly exaggerated degree in FIGS. 9 and 10 for expository purposes.

Referring now to FIG. 10, upon removal of the overwrap film 50, the portions of the heat-sealable coating 42' bonded thereto and the underlying portions of ink 40 are removed therewith. The result is substantially the same as that shown in FIG. 7 except that, in the areas outside of the desired pattern, instead of the ink surface 40 being exposed by removal of the overwrap film 50, the remaining portions of the heat-sealable coating 42' are disposed on the outer carton surface, the ink 40 being readily visible through the transparent coating 42', however. As in the first embodiment, it is critical that the portions of the heat-sealable coating 42' actuated by the heat and pressure bond to the ink 40 on the one hand, and to the transparent film 50, on the other hand, with appreciably greater strength than the ink 40 bonds to the outer surface of the carton 10 or the transparent film 50 bonds to the unactuated portions of the heat-sealable coating 42'.

Referring now to FIGS. 11–13, therein illustrated is a third embodiment of the present invention wherein the differentially adherent patterns between the transparent overwrap film 50 and the ink 40 are achieved exclusively through the selective application of heat and pressure without the use of a heat-sealable coating applied either in a pattern 42 or a uniform layer 42' intermediate the overwrap film 50 and the ink 40.

Referring now to FIG. 11 in particular, therein illustrated is the composite of FIG. 2—comprising the carton 10 and the ink 40—with a transparent film 50 overwrapping the erected, filled and closed carton. For this embodiment, the transparent film 50 is preferably the aforementioned one-side PVDC, one side acrylic coated biaxially oriented polypropylene film (available under the trade name BICOR ASB from the Films Division of Mobil Chemical Company.) While such a film tends to be more expensive than a two-side acrylic coated polypropylene film, the extra cost is usually offset by the savings resulting from the material and application costs eliminated by dispensing with the separate heat-sealable coating.

Especially useful in the practice of the third embodiment are those inks, typically those which contain high solvent residues, which exhibit certain characteristics of heat-sealable coatings and thus do not require that a heat-sealable coating be applied intermediate the film and ink. One such ink is available from Spectrum Inks of Clifton, N.J. under the trade name "Spectroseal".

Referring now to FIG. 12, the selective application of heat and pressure to the overwrap film 50 causes the overwrap film to bond with the underlying ink 40 in the desired pattern. The pressures, temperatures and times required to achieve the necessary bonding will, of course, be a function of the materials used, as in the second embodiment.

Referring now to FIG. 13, upon removal of a portion of the transparent film 50, the underlying portions of ink 40 bonded thereto by the selective application of heat and pressure are now removed with the overwrap portion to reveal a deinked carton surface 10 in the desired pattern. The tampered carton according to this embodiment is substantially similar to that shown in FIG. 7, except for the absence of any separate and distinct heat-sealable coating 42.

In the second and third embodiments, the selective application of heat and pressure to selectively bond the film to the ink in differentially adherent patterns may be performed either during and as part of the overwrapping step or, if more convenient, at a later time.

Each of the embodiments of the present invention have their own advantages and disadvantages rendering them more or less suitable for particular applications. For example, in the first embodiment, the carton manufacturer applies the coating in a predetermined pattern defining the message which will be communicated to the potential purchaser by a tampered package. On the other hand, the packager may utilize the intermediate provided by the carton manufacturer with only minor modification of his ordinary overwrapping equipment, and yet secure for himself the benefit of tamper-evident packaging. The second embodiment provides the packager with an opportunity to decide for himself the language of the warning to be evidenced by the tamper-evident packaging, but he will generally have to modify his conventional overwrapping equipment substantially in order to provide for the selective application of heat and pressure. The third embodiment offers advantages and disadvantages substantially similar to the second embodiment except that there is also a possibility of reduced costs (due to the absence of a heat-sealable coating) and the possibility of inferior bonding between the transparent film and ink (due again to the absence of heat-sealable coating.) In any of the three embodiments auxilliary equipment may be used instead of modifying conventional equipment.

In the "uniform application of heat and pressure", as that term is used in the description of the first embodiment, generally the heat and pressure will be applied uniformly to the overwrap on all sides (including ends) of the overwrap carton, but this is not necessarily the case. For example, the heat and pressure may be uniformly applied only on certain panels or certain flaps and, indeed, may be applied only in particular bands extending across or along one or more sides. The critical factor is that the heat and pressure are applied uniformly both to the areas of the overwrap film overlying the heat-sealable coating and to at least some of the adjacent areas of the overwrap film not overlying the heat-sealable coating. For example, only particular sides or ends of the overwrap carton may be passed by a heat source. Where the message intended to be communicated to the purchaser is arranged in parallel bands extending about an overwrapped carton, the pressure may be uniformly applied only in those bands, the pressure affecting both the areas in the band overlying the heat-sealable coating and those areas in the band not overlying the heat-sealable coating. For the purposes of the present specification and the appended claims, all of these alternatives are encompassed within the general terminology of "uniform application of heat and pressure" as used in conjunction with the first embodiment of the present invention.

In the "selective application of heat and pressure", as that term is used in the description of the second and third embodiments, the heat may be applied generally uniformly to the overwrap film and the pressure selectively applied in a given pattern, as by the use of a room temperature relief roller or die. Alternatively, the pressure may be applied generally uniformly to the overwrap film and the heat selectively applied in a given pattern, as by the use of radiant energy or laser beams to produce the selective heating. Where the heat is being applied generally uniformly, it may be applied by ambient temperature; and where the pressure is being applied generally uniformly, it may be applied by ambient atmospheric pressure. For the purposes of the present specification and the appended claims, all of these alternatives are encompassed within the general terminology of "selective application of heat and pressure" as used in conjunction with the second and third embodiments of the present invention.

To summarize, the present invention provides tamper-evident packaging wherein the tampering is evidenced by the appearance of a selected graphic or verbal communication on the outer surface of the container so that even the first-time user of the product will recognize that the product packaging has been tampered with. The notice remains on the carton surface even if new overwrap is applied thereto. Furthermore, the tamper-evident packaging is provided at only a minimal cost over regular packaging.

Now that the preferred embodiments of the present invention have been shown and described in detail, various modifications and improvements thereon will become readily apparent to those skilled in the art without departing from the spirit and scope of the present invention. Accordingly, the appended claims should be broadly construed.

What is claimed is:

1. Tamper-evident packaging comprising:

(A) an erected, filled, and closed carton having an outer surface with ink thereon visible from outside of said closed carton; and (B) a transparent film overwrapping said closed carton and secured to said ink on said outer carton surface in selected differentially adherent patterns;

whereby removal of said film from said overwrapped carton also removes said ink in one of said selected patterns to reveal a desired pattern of deinked outer carton surface and thereby evidence tampering.

2. The packaging of claim 1 additionally comprising a transparent heat-sealable coating disposed in said one selected pattern intermediate said ink and said film, said coating being bonded to an underlying portion of said ink and to said film; whereby removal of said film from said overwrapped carton also removes said coating and said underlying portion of said ink in said one selected pattern to reveal an outer carton surface deinked in the form of a meaningful message to evidence tampering.

3. The packaging of claim 2 wherein said coating has been activated by the uniform application of heat and pressure to bond with said film.

4. The packaging of claim 2 wherein said ink is secured to said outer carton surface in a pattern of surface detail by a first bond; said coating is secured to said ink in said one pattern by a second bond; and said film is secured to said coating by a third bond; said second and third bonds being appreciably stronger than said first bond, whereby removal of said film from said overwrapped carton also removes said coating and the portion of said ink underlying said coating to reveal a desired pattern of deinked outer carton surface and thereby evidence tampering.

5. The packaging of claim 1 additionally comprising a transparent heat-sealable coating uniformly disposed intermediate said ink and said film, said coating uniformly bonding to said ink and having been activated by a selective application of heat and pressure to bond in said one selected pattern with said film; whereby removal of said film from said overwrapped carton also removes said coating in said one selected pattern and an underlying portion of said ink in said one selected pattern to reveal an outer carton surface deinked in the form of a meaningful message to evidence tampering.

6. The packaging of claim 1 wherein said overwrap film is directly and immediately secured to said ink on said outer carton surface in selected differentially adherent patterns as a result of the differential application of heat and pressure to said film.

7. A method of manufacturing tamper-evident packaging comprising the steps of:

(A) providing an erected, filled and closed carton having an outer surface with ink thereon visible from outside the closed carton; and (B) overwrapping the closed carton with a transparent film and securing the film to the ink on the outer carton surface in selected differentially adherent patterns;

whereby removal of the film from the overwrapped carton also removes the ink in one of the selected patterns to reveal the desired pattern of deinked outer carton surface to evidence tampering.

8. The method of claim 7 wherein prior to step (B) a transparent heat-sealable coating is disposed in the one selected pattern on the outer carton surface and uniformly bonded to the underlying portion of the ink, and in step (B) the film is secured to the ink by activating the coating by the uniform application of heat and pressure to bond the coating to the film in the one selected pattern; whereby removal of the film from the overwrapped carton also removes the coating and the underlying portion of the ink in the one selected pattern to reveal an outer carton surface deinked in the form of a meaningful message to evidence tampering.

9. The method of claim 7 wherein prior to step (B) a transparent heat-sealable coating is uniformly disposed on the outer carton surface and uniformly bonded to the underlying ink, and in step (B) the coating is activated by selective application of heat and pressure to bond the coating in the one selected pattern with the film; whereby removal of the film from the overwrapped carton also removes the coating in the one selected pattern and the underlying portion of the ink in the one selected pattern to reveal an outer carton surface deinked in the form of a meaningful message to evidence tampering.

10. The method of claim 7 wherein said ink is secured to the outer carton surface by a first bond, the heat-sealable coating is secured to the ink by a second bond, and the film is secured to the coating by a third bond, the second and third bonds being stronger than the first bond.

11. The method of claim 7 wherein in step (B) the film is directly and immediately secured to the ink on the outer carton surface in selected differentially adherent patterns as a result of the differential application of heat and pressure to the film.

12. An intermediate in the manufacture of tamper-evident packaging comprising:

(A) a carton blank adapted to be erected into a carton, filled with product, closed, and overwrapped with a transparent film;

(B) ink defining a pattern of surface detail being secured by a first bond to a surface of said blank becoming the outer surface of the erected carton; and (C) a transparent heat-sealable coating disposed on said ink in a given pattern, said coating forming a second bond between said ink and said coating and being activatable to form a third bond between said coating and the film, said second and third bonds being appreciably stronger than said first bond;

whereby removal of the film from the overwrapped carton also removes said coating and the portion of said ink underlying said coating to reveal a desired pattern of deinked outer carton surface and thereby evidence tampering.

13. The intermediate of claim 12 wherein said second and third bonds are of generally equal strength.

14. The intermediate of claim 12 wherein said coating is disposed on said ink in a given pattern such that removal of said ink in said given pattern reveals indicia evidencing tampering.

15. The intermediate of claim 14 wherein said given pattern comprises indicia evidencing tampering.

16. The intermediate of claim 12 wherein said ink is substantially not heat sealable with the film in the absence of said coating therebetween.

17. The intermediate of claim 12 wherein said carton is comprised of paperboard; said ink is lithographic ink; said coating is an acrylic; and the film is biaxially oriented polypropylene.

18. The intermediate of claim 12 wherein said coating is activatable by heat and pressure to form said third bond.

19. The intermediate of claim 18 wherein said coating is activatable by the application of 200°–300° F. and 10–20 psi for 1–2 seconds.

20. A method of manufacturing an intermediate in the manufacture of tamper-evident packaging comprising the steps of:

(A) providing a carton blank adapted to be erected into a carton, filled with product, closed, and overwrapped with a transparent film;

(B) applying ink in a pattern of surface detail to a surface of the blank becoming the outer surface of the erectd carton, the ink being secured to the outer surface by a first bond; and (C) applying a transparent heat-sealable coating on the ink in a given pattern, the coating forming a second bond with the ink and being activatable to form a third bond with the film, the second and third bonds being appreciably stronger than the first bond;

whereby removal of the film from the overwrapped carton also removes the coating and the portion of the ink underlying the coating to reveal a desired pattern of deinked outer carton surface to evidence tampering.

* * * * *